US005743416A

United States Patent [19]

Yemini

[11] Patent Number: 5,743,416

[45] Date of Patent: Apr. 28, 1998

[54] TOOL RACK

[75] Inventor: Zvi Yemini, Tel Aviv, Israel

[73] Assignee: Zag Ltd., Rosh Haayin, Israel

[21] Appl. No.: 755,880

[22] Filed: Dec. 2, 1996

[51] Int. Cl.[6] ..... A47F 7/00

[52] U.S. Cl. ..... 211/70.6; 248/220.42

[58] Field of Search ..... 211/70.1, 70.6, 211/88, 89, 94; 248/220.42, 220.41, 220.43, 314

[56] References Cited

U.S. PATENT DOCUMENTS

| | | | |
|---|---|---|---|
| 2,805,777 | 9/1957 | Larson | 211/70.6 |
| 3,269,550 | 8/1966 | Marcus | 248/220.42 |
| 3,298,531 | 1/1967 | Wilcke | 211/70.6 |
| 3,489,382 | 1/1970 | Larson | 248/220.42 |

*Primary Examiner*—James R. Brittain
*Assistant Examiner*—Gerald A. Anderson
*Attorney, Agent, or Firm*—Mark M. Friedman

[57] ABSTRACT

A tool rack assembly selectively mountable either directly to a wall or on a vertical peg-board, includes a rack, integrally formed from molded polymer material, and a plurality of peg-board brackets. The rack is formed with an upper sheet-like element arranged substantially horizontally and having a plurality of apertures for receiving tools, and a lower sheet-like element spaced below the upper sheet-like element, and having a plurality of apertures corresponding to said apertures of said upper sheet-like element. Side portions connect between the upper and lower sheet-like elements and maintain them in vertically spaced relation. The tool rack has a strip extending along its rear edge forming a vertical flange with a number of attachment holes. The peg-board brackets, each of which has at least one curve-ended peg for locking within a hole of the peg-board, are engagable within the attachment holes for attaching the tool rack to the peg-board. The tool rack assembly preferably employs apertures with thickened reinforced rims, and includes a composite aperture for receiving a saw-like tool. The tool rack may also feature a support rail for receiving various tool rack accessories.

11 Claims, 4 Drawing Sheets

TOOL RACK

FIELD AND BACKGROUND OF THE INVENTION

The present invention relates to tool racks and, in particular, it concerns a reinforced molded plastic tool rack which is mountable on a peg-board.

It is known to provide storage for tools in the form of a shelf or rack mounted on a wall. Typically, tool racks are made from metal or wood with a variety of different size circular apertures cut therein. The tool rack is used by inserting an elongated part of a tool, such as the shaft of a screw-driver, into the aperture until a wider part of the tool, such as the handle, rests on the periphery of the aperture.

Tool-rack-type storage is typically limited to certain types of tools, such as screw-drivers, chisels and other generally straight tools of similar designs. By addition of round-ended slots, tool racks can also be employed to store certain sorts of pliers and the like which have diverging handles. More complex shaped tools, however, such as saws, cannot generally be accommodated by a tool rack. Furthermore, accessories such as electrical extension cords and small items such as screws and nails require separate storage.

Tool racks are generally designed for permanent attachment to a wall by use of screws, bolts, or the like. As a result, careful planning is required as to the positioning of tool racks. Relocation or expansion of the tool rack storage space cannot be easily achieved.

Attempts have been made to produce tool racks from molded-plastic. However, because of the heavy wear associated with the repeated insertion and removal of metal tools, the plastic edges of the apertures quickly deteriorate. The fact that many tool are also sharp or abrasive further aggravates this problem.

There is therefore a need for plastic tool racks which are sufficiently strong to withstand the wear of normal use, which may be removably mounted for convenient relocation, and which provide storage for a wider range of tools and accessories than conventional designs.

SUMMARY OF THE INVENTION

The present invention is a reinforced molded plastic tool rack assembly which is mountable on a peg-board.

According to the teachings of the present invention there is provided, a tool rack assembly selectively mountable either directly to a wall or on a vertical peg-board, the tool rack assembly comprising: (a) a rack integrally formed from molded polymer material, the rack having: (i) an upper sheet-like element arranged substantially horizontally and having a plurality of apertures for receiving tools, the upper sheet-like element having a rear edge, (ii) a lower sheet-like element spaced below the upper sheet-like element, the lower sheet-like element having a plurality of apertures corresponding to the apertures of the upper sheet-like element, (iii) side portions connecting between the upper and lower sheet-like elements for maintaining them in vertically spaced relation, and (iv) a strip extending along the rear edge to form a vertical flange, the strip having a number of attachment holes; and (b) a plurality of peg-board brackets engagable within the attachment holes for attaching the tool rack to the peg-board, each of the peg-board brackets including at least one curve-ended peg for locking within a hole of the peg-board.

According to a further feature of the present invention, each of the peg-board brackets further includes a straight lower peg for engaging one of the attachment holes of the flange, and wherein the at least one curve-ended peg is positioned above the straight lower peg.

According to a further feature of the present invention, each of the pegboard brackets has a lower edge positioned relative to the straight lower peg so as to abut the upper sheet-like member when the lower peg is engaged within the attachment hole, and wherein the upper sheet-like member features a ridge associated with each of the attachment holes for retaining the peg-board brackets with the lower peg engaged within the attachment hole.

According to a further feature of the present invention, the at least one curve-ended peg is implemented as two curve-ended pegs horizontally spaced from each other.

According to a further feature of the present invention, each of the apertures in the upper sheet-like element is formed with a thickened rim.

According to a further feature of the present invention, at least one of the apertures in the upper sheet-like element is formed as a combination of at least one substantially circular aperture intersecting with an elongated slot for receiving a saw-like tool.

According to a further feature of the present invention, at least one of the side portions has a support rail, the tool rack assembly further comprising at least one tool rack accessory slidably engagable on the support rail.

There is also provided, according to the teachings of the present invention, a tool rack assembly for mounting on a wall, the tool rack assembly comprising a rack integrally formed from molded polymer material, the rack having: (a) an upper sheet-like element arranged substantially horizontally and having a plurality of apertures for receiving tools, the upper sheet-like element having a rear edge; (b) a lower sheet-like element spaced below the upper sheet-like element, the lower sheet-like element having a plurality of apertures corresponding to the apertures of the upper sheet-like element; and (c) side portions connecting between the upper and lower sheet-like elements for maintaining them in vertically spaced relation, wherein each of the apertures in the upper sheet-like element is formed with a thickened rim.

According to a further feature of the present invention, the thickened rim has a rounded cross-section.

According to a further feature of the present invention, at least one of the apertures in the upper sheet-like element is formed as a combination of at least one substantially circular aperture intersecting with an elongated slot for receiving a saw-like tool.

There is also provided, according to the teachings of the present invention, a tool rack assembly for mounting on a wall, the tool rack assembly comprising a rack integrally formed from molded polymer material, the rack having: (a) an upper sheet-like element arranged substantially horizontally and having a plurality of apertures for receiving tools, the upper sheet-like element having a rear edge; (b) a lower sheet-like element spaced below the upper sheet-like element, the lower sheet-like element having a plurality of apertures corresponding to the apertures of the upper sheet-like element; and (c) side portions connecting between the upper and lower sheet-like elements for maintaining them in vertically spaced relation, wherein at least one of the apertures in the upper sheet-like element is a combination aperture formed as a combination of at least one substantially circular aperture intersecting with an elongated slot for receiving a saw-like tool.

According to a further feature of the present invention, the width of the elongated slot is less than about half of the diameter of the substantially circular aperture.

According to a further feature of the present invention, the combination aperture is formed from a plurality of substantially circular apertures, and wherein both ends of the elongated slot are enclosed by the plurality of substantially circular apertures.

According to a further feature of the present invention, the slot is aligned with the centers of the substantially circular apertures.

There is also provided according to the teachings of the present invention, a tool rack assembly for mounting on a wall, the tool rack assembly comprising: (a) a rack integrally formed from molded polymer material, the rack having: (i) art upper sheet-like element arranged substantially horizontally and having a plurality of apertures for receiving tools, the upper sheet-like element having a rear edge, (ii) a lower sheet-like element spaced below the upper sheet-like element, the lower sheet-like element having a plurality of apertures corresponding to the apertures of the upper sheet-like element, and (iii) side portions connecting between the upper and lower sheet-like elements for maintaining them in vertically spaced relation, at least one of the side portions having a support rail; and (b) at least one tool rack accessory slidably engagable on the support rail.

According to a further feature of the present invention, the at least one tool rack accessory includes a tray.

According to a further feature of the present invention, the at least one tool rack accessory includes at least one hook.

According to a further feature of the present invention, the rail is of substantially T-like cross-section.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a reinforced molded plastic tool rack assembly which is mountable on a peg-board.

The principles and operation of a tool rack assembly according to the present invention may be better understood with reference to the drawings and the accompanying description.

Figure 1:
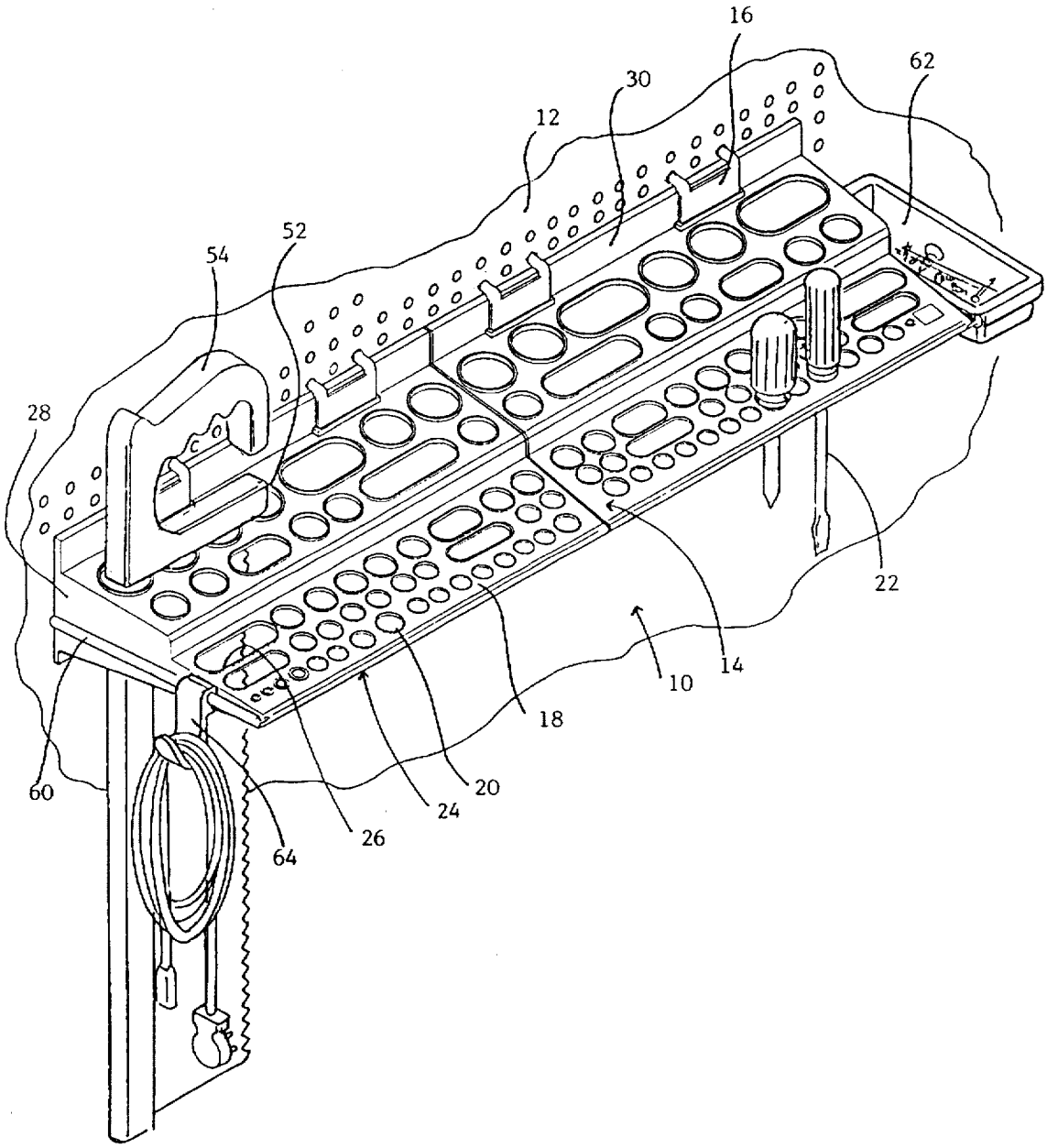
FIG. 1 is a perspective view of a tool rack assembly, constructed and operative according to the teachings of the present invention, showing a tool rack in use attached by brackets to a peg board.

Referring now to the drawings, FIG. 1 shows a tool rack assembly, generally designated 10, constructed and operative according to the teachings of the present invention, mounted on a vertical peg board 12. Tool rack assembly 10 includes a tool rack 14, integrally formed from molded polymer material, and a number of peg-board brackets 16 for attaching tool rack 14 to peg board 12.

Tool rack 14 has an upper sheet-like element 18 having a plurality of apertures 20 for receiving tools 22. A lower sheet-like element 24, featuring a plurality of apertures 26 corresponding to apertures 20, is spaced below upper sheet-like element 18. Two side portions 28 connect between upper sheet-like element 18 and lower sheet-like element 24, maintaining them in vertically spaced relation.

It should be appreciated that upper sheet-like element 18 and lower sheet-like element 24 are not necessarily, or even preferably, planar. Thus, in the example illustrated, upper sheet-like element 18 is formed as a two-tier structure. Furthermore, upper sheet-like element 18 and lower sheet-like element 24 are described as "substantially horizontal" to convey their shelf-like deployment. However, their angle to the horizontal may vary considerably for reasons of comfort of use, structural rigidity or esthetics.

Tool rack 14 features a strip 30 extending along the rear edge of upper sheet-like element 18 so as to form a vertical flange. Strip 30 is formed with a number of attachment holes 32 (see FIG. 3).

Figure 2:
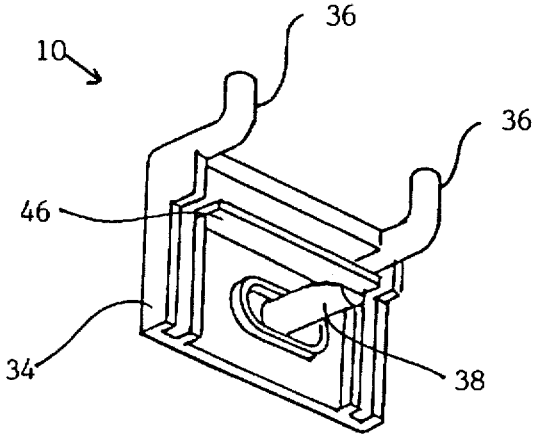
FIG. 2 is an enlarged perspective view of a peg board bracket for use in the tool rack assembly of FIG. 1.

It is a particular feature of a preferred embodiment of the present invention that tool rack 14 is selectively mountable both directly to a wall in a conventional manner and on a standard peg board. The former option is implemented by simply employing screws, nails or the like directly within attachment holes 32 to fix tool rack 14 to a wall. The latter option is implemented by engaging peg-board brackets 16 within attachment holes 32. Tool rack assembly 10 may then be readily positioned Details of the a preferred design of peg-board brackets 16 and the corresponding features of tool rack 14 will now be described with reference to FIGS. 2 and 3. FIG. 2 shows a peg-board bracket 16 having a rectangular back 34. Two curve-ended pegs 36 extend from back 34 adjacent to its upper corners, and a straight lower peg 38 extends from near its center.

Figure 3:
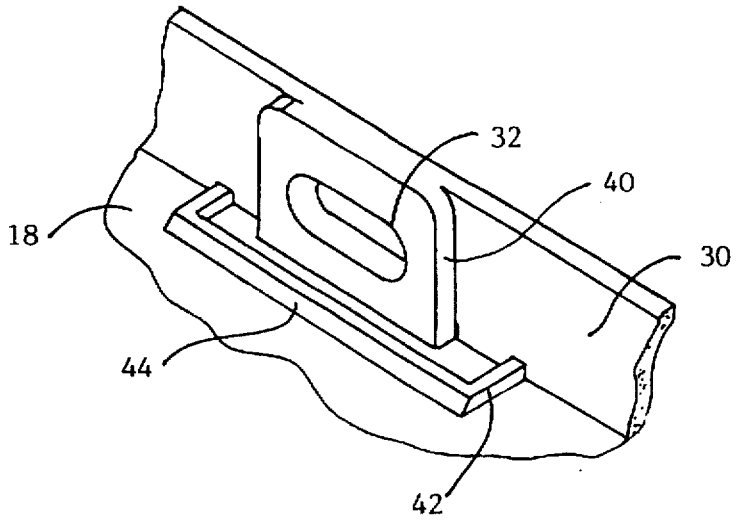
FIG. 3 is an enlarged perspective view of a preferred design of an attachment region of the tool rack of FIG. 1.

FIG. 3 shows the parts of upper sheet-like element 18 and strip 30 adjacent to one of attachment holes 32. Strip 30 has features, such as projecting shoulders 40, for cooperating with the inner surface of back 34 so as to align peg-board bracket 16 with attachment hole 32. Upper sheet-like element 18 features a retaining ridge 42 with a wedge-shaped front edge 44.

The dimensions of peg-board bracket 16 are matched to those of the attachment region of tool rack 14. Specifically, the distance from straight lower peg 38 to the lower edge of peg-board bracket 16 is made to match the height of the attachment hole 32 above upper sheet-like element 18 such that, when straight lower peg 38 is engaged within attachment hole 32, the bottom edge of peg-board bracket 16 abuts upper sheet-like element 18. Similarly, a ridge 46 across peg-board bracket 16 just below upper pegs 36 is positioned so as to engage against the upper edge of strip 30 when peg-board bracket 16 is engaged. These features serve to maintain alignment between peg-board bracket 16 and tool rack 14.

In addition, ridge 42 serves to enable self-locking attachment of peg-board brackets 16 to tool rack 14. Specifically, peg-board bracket 16 is positioned with the end of straight lower peg 38 within attachment hole 32 and is gently forced towards strip 30. Wedge shaped front edge 44 together with the inherent flexibility of the molded plastic material of tool rack 14 allows the bottom of peg-board bracket 16 to slide over ridge 42 until it clips into a fully engaged position with its bottom edge caught behind ridge 42.

Once peg-board brackets 16 are attached to tool rack 14, tool rack assembly 10 may be fixed at any desired position on peg board 12 by inserting the curved ends of pegs 36 while tool rack 14 is held inclined at an appropriate angle and then lowering tool rack 14 until it is substantially horizontal such that lower pegs 38 also engage holes of peg board 12.

Thus, it will be readily appreciated that the combination of attachment holes 32 and peg-board brackets 16 provide a flexible modular system with options of conventional wall mounting techniques and of easily relocatable peg-board type mounting.

Figure 4:
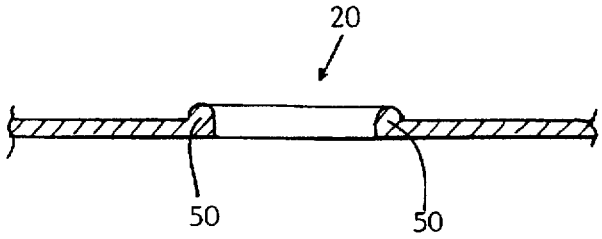
FIG. 4 is a cross-sectional view of an aperture of the tool rack of FIG. 1.

Turning now to FIG. 4, it is a further feature of a preferred embodiment of the present invention that apertures 20, and preferably also apertures 26, are formed with a thickened rim 50. Thickened rim 50 serves to reinforce the edges of the apertures sufficiently to withstand repeated knocks and abrasion from insertion of metal tools. Preferably, thickened rim 50 has an at least partially rounded cross-section. Thus, in the cross-section illustrated, the upper surface of thickened rim approximates to a semicircular shape. This rounded shape serves to spread applied stresses, thereby minimizing the risk of cracking of the plastic.

Figure 5:
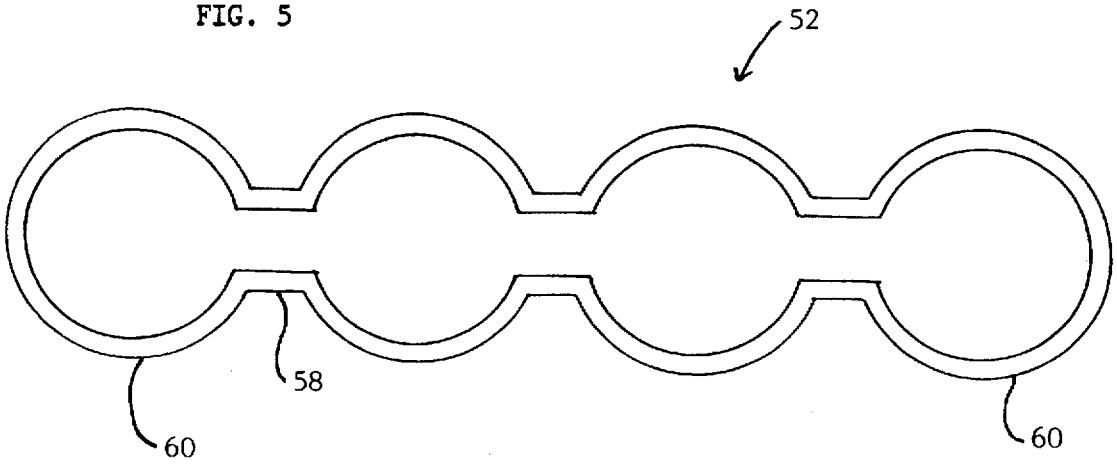
FIG. 5 is a plan view of a composite aperture of the tool rack assembly of FIG. 1, for receiving a saw.
Figure 6:
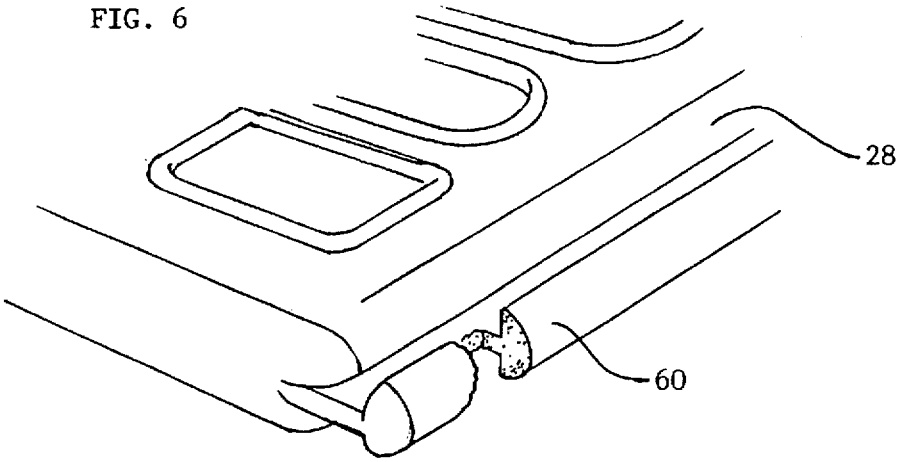
FIG. 6 is an enlarged perspective view of a support rail of the tool rack assembly of FIG. 1.

Turning now to FIG. 5, tool rack 14 preferably also includes a composite aperture 52 for receiving a saw 54 (FIG. 1), or other similar tool. As mentioned earlier, conventional tool racks are limited in the type of tools they are able to accommodate. Particularly problematic are saws which have an elongated blade holder. The width of the blade holder often dictates that any slot wide enough to accommodate the blade does not safely retain the handle of the saw. Composite aperture 52 overcomes this problem.

Specifically, composite aperture 52 is formed as a combination of at least one substantially circular aperture 56 intersecting with an elongated slot 58. The width of slot 58 is less than the diameter of aperture 56, and is preferably less than about half its diameter. Slot 58 is typically aligned with the center of aperture 56.

This structure allows a wide portion of the elongated part of a tool, such as a saw-blade holder, to be inserted easily through the larger circular part 56 of aperture 52. Once the tool is fully inserted, however, the handle portion becomes firmly lodged against the edges of narrower slot 58.

Typically, composite aperture 52 is formed from a plurality of substantially circular apertures 56, centered along the line of slot 58. In this case, each end of elongated slot 58 is preferably enclosed by one of the substantially circular apertures. This ensures that composite aperture 52 terminates in curves of relatively large radius so as to distribute local stresses, thereby minimizing the possibility of tearing of the plastic material.

Finally, turning to FIGS. 6–9, one, or both, of side portions 28 may feature a support rail 60 for receiving a tool rack accessory. Support rail 60 is preferably of substantially T-shaped section so as to provide strong interlocking with accessories mounted thereon.

The term "T-shaped" is used herein in the description and claims to refer to a rail structure which has some degree of overhang on both sides. However, it does not necessarily imply symmetry between the two overhangs. Nor is it intended that the shape should be rectangular. Thus, support rail 60 is shown here in a round-topped form.

Figure 7:
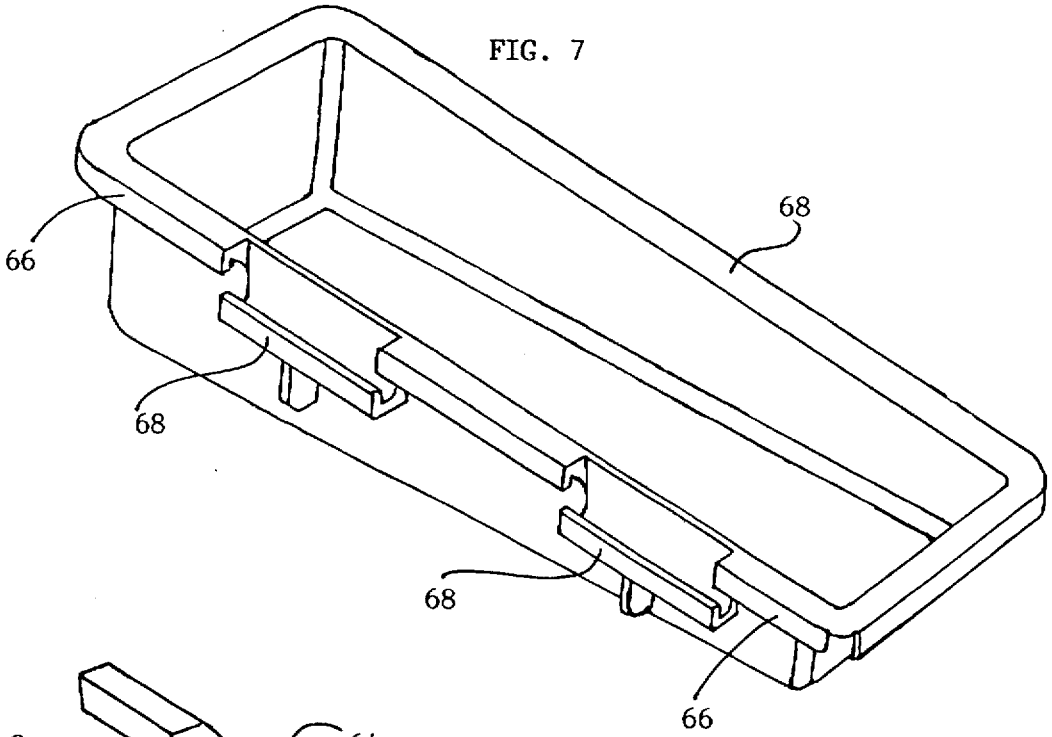
FIG. 7 is a perspective view of a tray of the tool rack assembly of FIG. 1.
Figure 8:
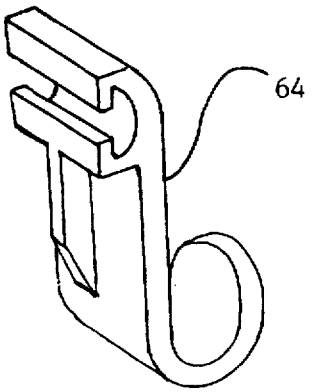
FIG. 8 is a perspective view of a hook of the tool rack assembly of FIG. 1.

Tool rack assembly 10 may include a wide range of tool rack accessories slidably engagable, on support rail 60. By way of example only, these may include a tray 62 and one or more hook 64, as illustrated in FIGS. 7 and 8, respectively.

Tray 62 has a series of alternating upper and lower track elements, designated 66 and 68, respectively, for engaging opposite sides of support rail 60. If the design of support rail 60 is such that it is not exactly horizontal, tray 62 may be slightly wedge-shaped as shown so as to provide a horizontal base. This facilitates convenient storage of small items such as screws and the like.

Hook 64 is formed with a T-shaped slot, corresponding to the shape of support rail 60. Hook 64 has a multitude of possible uses such as, for example, for hanging an electrical extension cord.

It will be appreciated that the above descriptions are intended only to serve as examples, and that many other embodiments are possible within the spirit and the scope of the present invention.

What is claimed is:

1. A tool rack assembly selectively mountable either directly to a wall or on a vertical peg-board, the tool rack assembly comprising:

(a) a rack integrally formed from molded polymer material, the rack having:

(i) an upper sheet-like element arranged substantially horizontally and having a plurality of apertures for receiving tools, said upper sheet-like element having a rear edge, (ii) a lower sheet-like element spaced below said upper sheet-like element, said lower sheet-like element having a plurality of apertures corresponding to said apertures of said upper sheet-like element, (iii) side portions connecting said upper and lower sheet-like elements for maintaining them in vertically spaced relation, and (iv) a strip extending along said rear edge to form a vertical flange, said strip having a number of attachment holes; and (b) a plurality of peg-board brackets engagable within said attachment holes for attaching said tool rack to the peg-board, each of said peg-board brackets including:

(i) at least one curve-ended peg for locking within a hole of the peg-board, (iii) a straight lower peg positiooed below said curve-ended peg for engaging one of said attachment holes of said flange, and (iii) a lower edge positioned relative to said straight lower peg so as to abut said upper sheet-like member when said lower peg is engaged within said attachment hole, wherein said upper sheet-like member features a ridge associated with each of said attachment holes for retaining said peg-board brackets with said lower peg engaged within said attachment hole.

2. The tool rack assembly of claim 1, wherein at least one of said side portions has a support rail, the tool rack assembly further comprising at least one tool rack accessory slidably engagable on said support rail.

3. The tool rack assembly of claim 1, wherein at least one of said apertures in said upper sheet-like element is formed as a combination of at least one substantially circular aperture intersecting with an elongated slot for receiving a saw-like tool.

4. The tool rack assembly of claim 1, wherein said at least one curve-ended peg is implemented as two curve-ended pegs horizontally spaced from each other.

5. The tool rack assembly of claim 1, wherein each of said apertures in said upper sheet-like element is formed with a thickened rim.

6. A tool rack assembly for mounting on a wall, the tool rack assembly comprising:

(a) a rack integrally formed from molded polymer material, the rack having:

(i) an upper sheet-like element arranged substantially horizontally and having a plurality of apertures for receiving tools said upper sheet-like element having a rear edge, (ii) a lower sheet-like element spaced below said upper sheet-like element, said lower sheet-like element having a plurality of apertures corresponding to said apertures of said upper sheet-like element, and (iii) side portions connecting said upper and lower sheet-like elements for maintaining them in vertically spaced relation, at least one of said side portions having a support rail; and (b) at least one tray slidably engagable on said support rail.

7. The tool rack assembly of claim 6, further comprising at least one hook slidably engagable on said support rail.

8. A tool rack assembly for mounting on a wall, the tool rack assembly comprising:

(a) a rack integrally formed from molded polymer material the rack having:

(i) an upper sheet-like element arranged substantially horizontally and having a plurality of apertures for receiving tools, said upper sheet-like element having a rear edge, (ii) a lower sheet-like element spaced below said upper sheet-like element, said lower sheet-like element having a plurality of apertures corresponding to said apertures of said upper sheet-like element, and (iii) side portions connecting said upper and lower sheet-like elements for maintaining them in vertically spaced relation, at least one of said side portions having a support rail; and (b) at least one hook slidably engagable on said support rail.

9. A tool rack assembly for mounting on a wall, the tool rack assembly comprising:

(a) a rack integrally formed from molded polymer material, the rack having:

(i) an upper sheet-like element arranged substantially horizontally and having a plurality of apertures for receiving tools, said upper sheet-like element having a rear edge, (ii) a lower sheet-like element spaced below said upper sheet-like element, said lower sheet-like element having a plurality of apertures corresponding to said apertures of said upper sheet-like element, and (iii) side portions connecting said upper and lower sheet-like elements for maintaining them in vertically spaced relation, at least one of said side portions having a support rail of substantially T-like cross-section; and (b) at least one tool rack accessory slidably engagable on said support rail.

10. The tool rack assembly of claim 9, wherein said at least one tool rack accessory includes a tray.

11. The tool rack assembly of claim 9, wherein said at least one tool rack accessory includes at least one hook.

* * * * *